US012151797B2

(12) United States Patent
Ueno

(10) Patent No.: US 12,151,797 B2
(45) Date of Patent: Nov. 26, 2024

(54) SHIP SPEED CONTROL SYSTEM, SHIP SPEED CONTROL METHOD, AND SHIP SPEED CONTROL PROGRAM

(71) Applicant: FURUNO ELECTRIC CO., LTD., Hyogo (JP)

(72) Inventor: Hideki Ueno, Takarazuka (JP)

(73) Assignee: FURUNO ELECTRIC COMPANY LIMITED, Hyogo (JP)

( * ) Notice: Subject to any disclaimer, the term of this patent is extended or adjusted under 35 U.S.C. 154(b) by 293 days.

(21) Appl. No.: 17/811,474

(22) Filed: Jul. 8, 2022

(65) Prior Publication Data

US 2023/0094878 A1 Mar. 30, 2023

(30) Foreign Application Priority Data

Sep. 29, 2021 (JP) ..... 2021-158709

(51) Int. Cl.
*B63H 21/21* (2006.01)

(52) U.S. Cl.
CPC ..... *B63H 21/21* (2013.01); *B63H 2021/216* (2013.01)

(58) Field of Classification Search
CPC ..... B63H 21/21; B63H 2021/216; F02D 2200/101; B63B 79/40
See application file for complete search history.

(56) References Cited

U.S. PATENT DOCUMENTS 5,177,683 A 1/1993 Oo et al.
2012/0010766 A1* 1/2012 Sako ..... B63H 21/21 701/21
2017/0137103 A1 5/2017 Ito
2017/0277189 A1* 9/2017 Johnson ..... B63H 25/06
2021/0253213 A1* 8/2021 Sato ..... B63H 20/08
2021/0255640 A1* 8/2021 Imamura ..... G01C 21/203
2022/0307429 A1* 9/2022 Sutoh ..... F02D 11/105
2023/0043206 A1* 2/2023 Narita ..... F02D 41/0002

FOREIGN PATENT DOCUMENTS

EP 3798111 A1 3/2021
JP 2017-088119 A 5/2017

OTHER PUBLICATIONS

The extended European search report issued by the European Patent Office on Mar. 15, 2023, which corresponds to European Patent Application No. 20190526.8-1009 and is related to U.S. Appl. No. 17/811,474.

* cited by examiner

*Primary Examiner* — Jelani A Smith
*Assistant Examiner* — Alyssa Rorie
(74) *Attorney, Agent, or Firm* — Studebaker & Brackett PC

(57) ABSTRACT

A ship speed control system includes: a ship speed deviation calculation module which calculates a ship speed deviation based on the difference between an actual ship speed and a ship speed target value; and an input gain adjustment module which adjusts a gain input to a throttle control function to a first gain value when the ship speed deviation is not less than a first threshold value, and adjusts the input gain to a second gain value which is larger than the first gain value and smaller than the initial gain value when the ship speed deviation is not less than the first threshold value and not less than the second threshold value.

20 Claims, 6 Drawing Sheets

SHIP SPEED CONTROL SYSTEM, SHIP SPEED CONTROL METHOD, AND SHIP SPEED CONTROL PROGRAM

CROSS-REFERENCE TO RELATED APPLICATION(S)

This application claims the priority benefits of Japanese application no. 2021-158709, filed on Sep. 29, 2021. The entirety of the above-mentioned patent application is hereby incorporated by reference herein and made a part of this specification.

TECHNICAL FIELD

The present invention relates to a technique for automatically controlling ship speed.

BACKGROUND

Conventionally, a technique for automatically controlling the ship speed is disclosed as in Japanese Patent Application Publication No. JP2017-88119.

DESCRIPTION OF THE DISCLOSURE

However, in the conventional configuration, there has been disclosed a control method for eliminating the difference between an actual ship speed and a ship speed target value based on the value of the engine speed associated with the ship speed target value. This control method only solved the difference between the actual ship speed and the ship speed target value, and did not take into account ride quality and safety of the passengers.

Therefore, a purpose of this disclosure is to improve the ride quality and safety performance of a passenger when performing the automatic ship speed control of a ship.

SUMMARY

A ship speed control system includes: a ship speed deviation calculation module configured to calculate a ship speed deviation based on a difference between an actual ship speed and a ship speed target value; and an input gain adjustment module configured to adjust an input gain into a throttle control function to a first gain value when the ship speed deviation is equal to or larger than a first threshold value; and to adjust the input gain to a second gain value larger than the first gain value and smaller than the initial value of the input gain when the ship speed deviation is smaller than the first threshold value and equal to or larger than the second threshold value.

A ship speed control system includes: processing circuitry configured: to calculate a ship speed deviation based on a difference between an actual ship speed and a ship speed target value; to adjust an input gain into a throttle control function to a first gain value when the ship speed deviation is equal to or larger than a first threshold value; and to adjust the input gain to a second gain value larger than the first gain value and smaller than the initial value of the input gain when the ship speed deviation is smaller than the first threshold value and equal to or larger than the second threshold value.

A ship speed control method includes: calculating a ship speed deviation based on a difference between an actual ship speed (V) and a ship speed target value (Vt); adjusting an input gain into a throttle control function to a first gain value when the ship speed deviation is equal to or larger than a first threshold value; and adjusting the input gain to a second gain value larger than the first gain value and smaller than the initial value of the input gain when the ship speed deviation is smaller than the first threshold value and equal to or larger than the second threshold value.

A non-transitory computer-readable storage medium storing processor-executable instructions that, when executed, cause one or more processors to calculate a ship speed deviation based on a difference between an actual ship speed (V) and a ship speed target value (Vt); to adjust an input gain into a throttle control function to a first gain value when the ship speed deviation is equal to or larger than a first threshold value; and to adjust the input gain to a second gain value larger than the first gain value and smaller than the initial value of the input gain when the ship speed deviation is smaller than the first threshold value and equal to or larger than the second threshold value.

In this configuration, according to the actual ship speed, the control may be performed using the first gain value and the second gain value. Thus, the control may be performed in consideration of the ride quality and safety of the passenger.

The ship speed control system may further include a speed stability determination module configured to determine that the actual ship speed becomes stable with respect to the ship speed target value; and to trigger the input gain adjustment module to adjust the input gain, when the ship speed deviation is equal to or less than a third threshold value; and the input gain adjustment module is configured to adjust the input gain to the first gain value under a condition, when the input gain adjustment module is being triggered by the speed stability determination module.

In this configuration, it is possible to perform control according to the actual ship speed without performing unnecessary control by determining whether or not the ship speed has been set.

In the ship speed control system, the first gain value and the second gain value are values obtained by dividing a preset initial value of the input gain.

In this configuration, the first gain value and the second gain value which are easy to stabilize the ship speed may be easily set.

The throttle control function of the ship speed control system is a control function under a proportional integral (PI) control.

In this configuration, it is possible to perform the PI control that efficiently approaches the ship speed target value.

The input gain adjustment module of the ship speed control system is further configured to adjust the first gain value or the second gain value only for the proportional gain under the PI control.

In this configuration, it is possible to follow the ship speed target value more gently.

The input gain adjustment module of the ship speed control system prohibits the subsequent adjustment of the input gain when the input gain adjustment module adjusts the input gain for a predetermined number of times.

In this configuration, the excessive adjustment of the input gain value is suppressed, and the ship speed control may be efficiently performed.

When the input gain becomes the first gain value as a result of adjusting the input gain, the input gain adjustment module of the ship speed control system prohibits the subsequent adjustment of the input gain.

In this configuration, ship speed control may be performed without unnecessary adjustment of the input gain.

The ship speed target value calculation module of the ship speed control system calculates the ship speed target value based on the set ship speed so that the actual ship speed approaches the set ship speed.

In this configuration, the ship speed target value may be calculated in accordance with the actual ship speed, and the ship speed may be controlled more efficiently.

The ship speed control system includes: a ship speed target value calculation module, the ship speed deviation calculation module, an input gain adjustment module, a speed stability determination module, a proportional integral (PI) control module, and a rotation speed calculation module. The ship speed target value calculation module calculates a ship speed target value from a set ship speed. The ship speed deviation calculation module calculates a ship speed deviation based on a difference between the actual ship speed and the ship speed target value. The input gain adjustment module adjusts an input gain to a throttle control function when the ship speed deviation is larger than a threshold. The speed stability determination module determines that the ship speed has become stabled by comparing the ship speed with the threshold from the ship speed deviation. The PI control module calculates a directive ship speed to be given to the throttle by using the input gain. The rotation speed calculation module calculates an engine speed from the directive ship speed.

The processing circuitry of the ship speed control system is further configured: to calculate a ship speed target value from a set ship speed; to calculate a ship speed deviation based on a difference between an actual ship speed and the ship speed target value; to adjust an input gain into a throttle control function when the ship speed deviation is larger than a threshold value; to determine from the ship speed deviation that the ship speed has become stabled; to make the input gain adjustment effective; to calculate a directive ship speed to be given to the throttle by using the input gain; and to calculate rotational speed from the directive ship speed.

In this configuration, the directive ship speed given to the throttle is calculated using the input gain calculated using the actual ship speed, and the engine speed may be calculated from the directive ship speed, so that the control, according to the actual ship speed, may be performed. Thus, the control may be performed in consideration of the ride quality and safety of the passenger.

DETAILED DESCRIPTION

Figure 1:
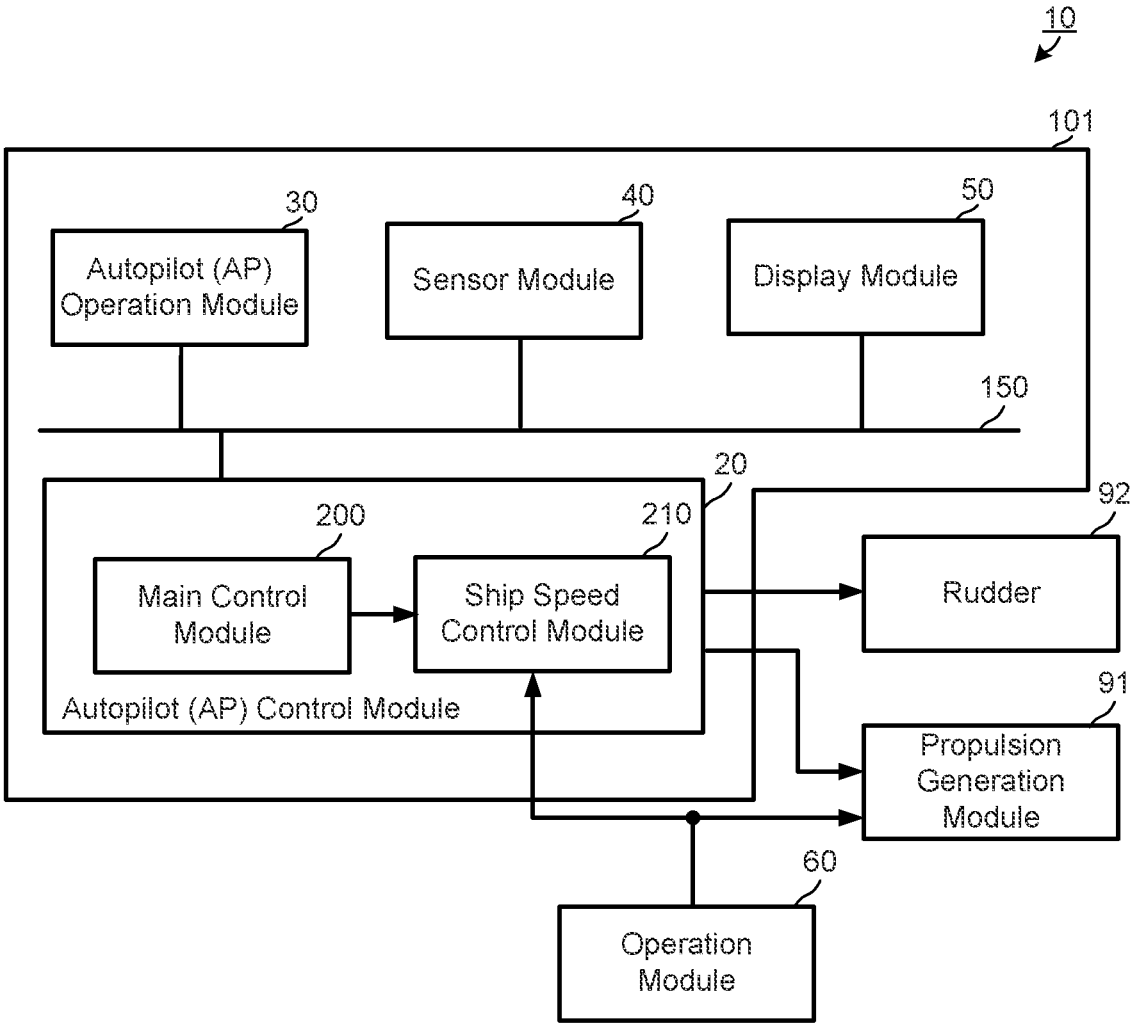
FIG. 1 is a functional block diagram showing a configuration of a ship speed control system, according to a first embodiment.
Figure 2:
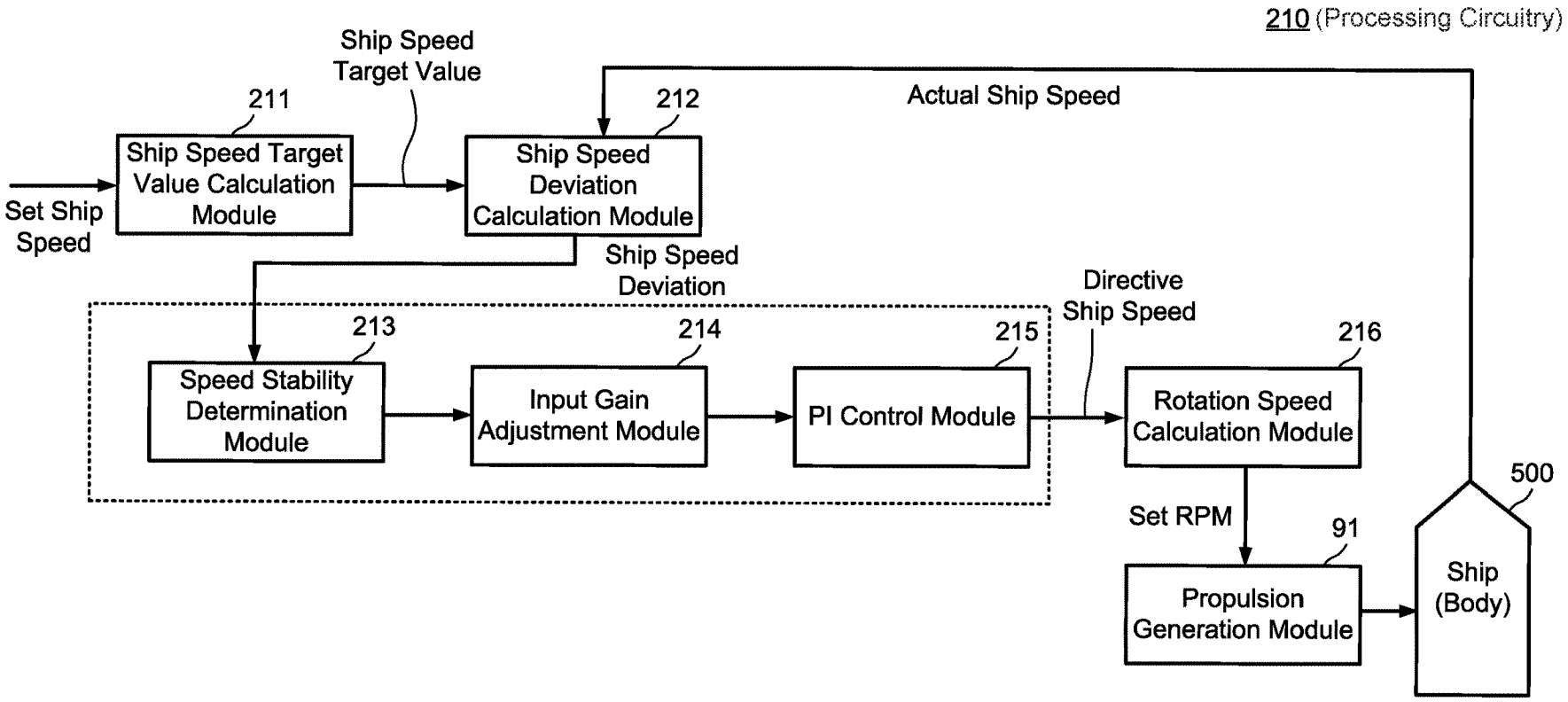
FIG. 2 is a functional block diagram showing a configuration for controlling ship speed of the ship speed control system, according to the first embodiment.
Figure 3:
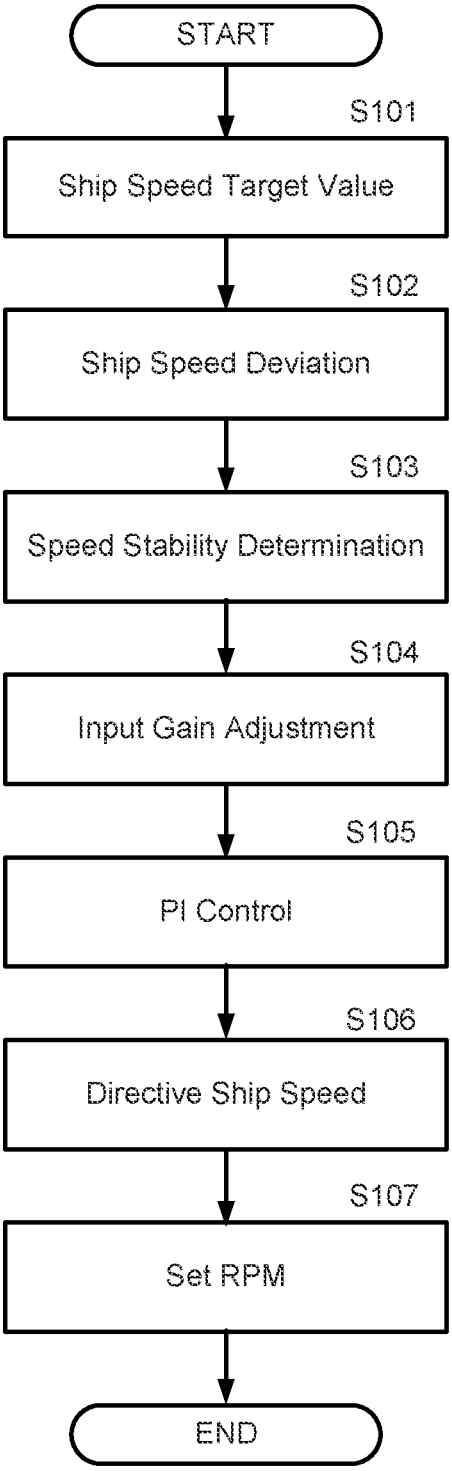
FIG. 3 is a flowchart showing the processing of the ship speed control system, according to the first embodiment.
Figure 4:
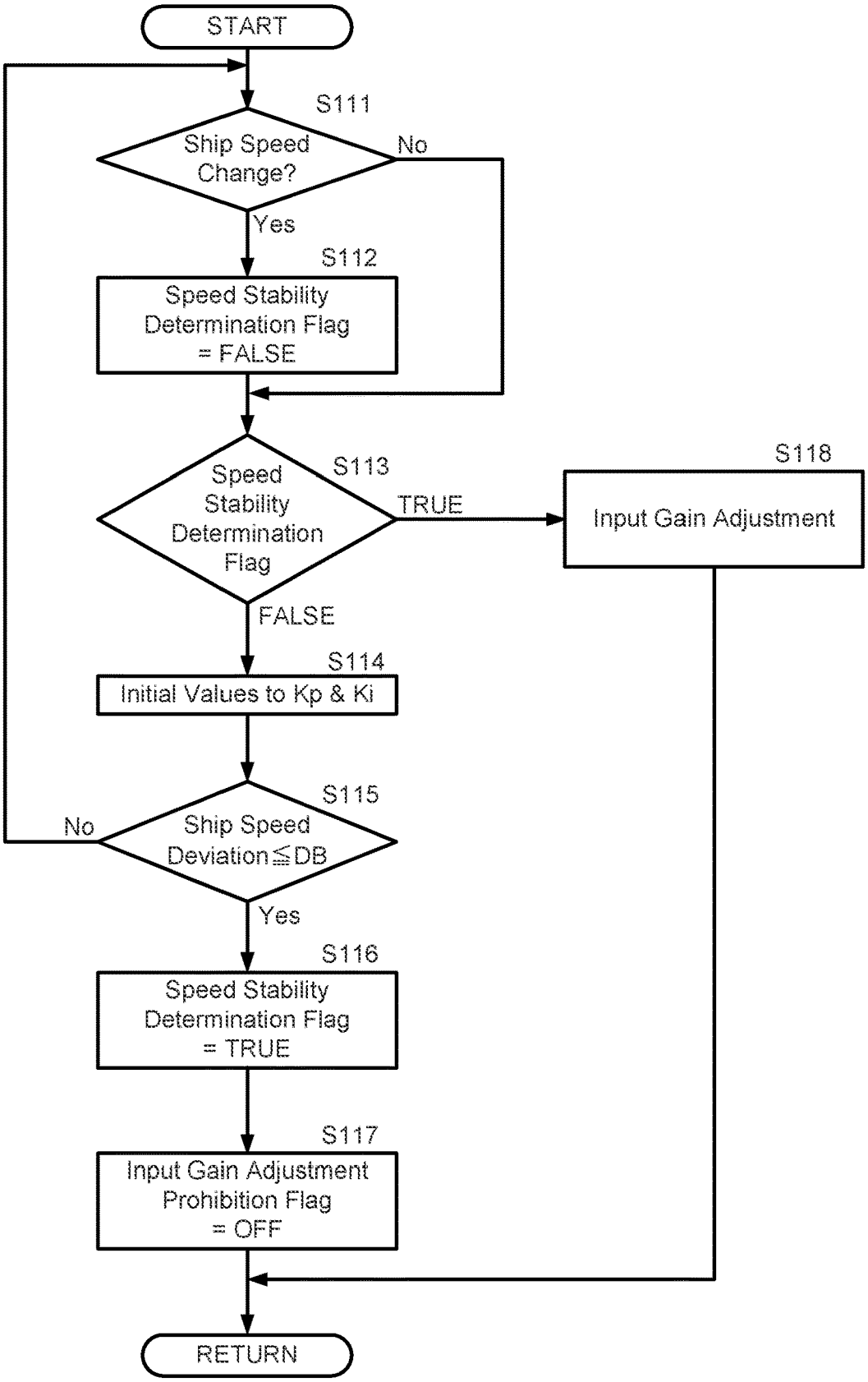
FIG. 4 is a flowchart showing a speed stability determination process in the ship speed control system, according to the first embodiment.
Figure 5:
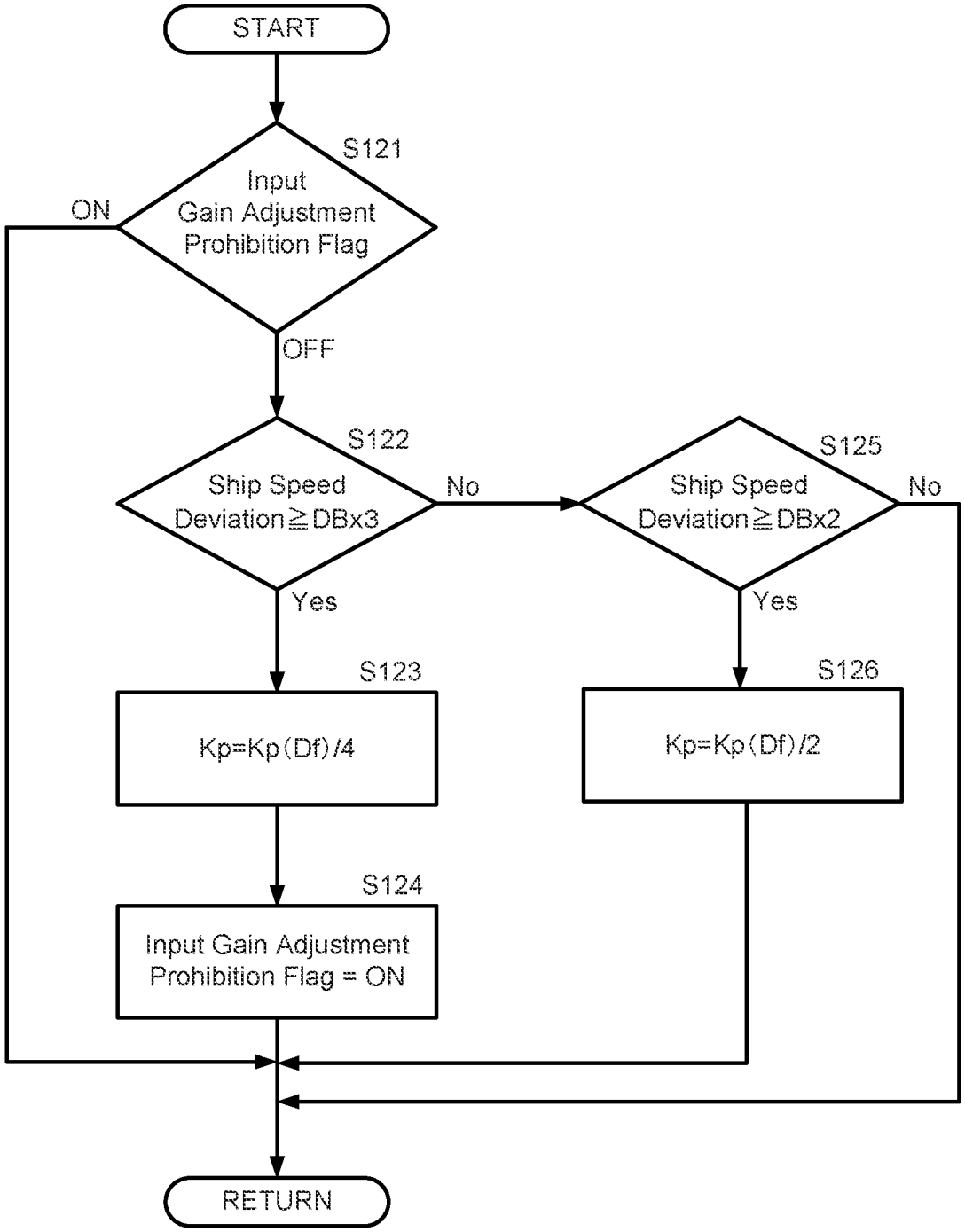
FIG. 5 is a flowchart showing an input gain adjustment process in the ship speed control system, according to the first embodiment.
Figure 6:
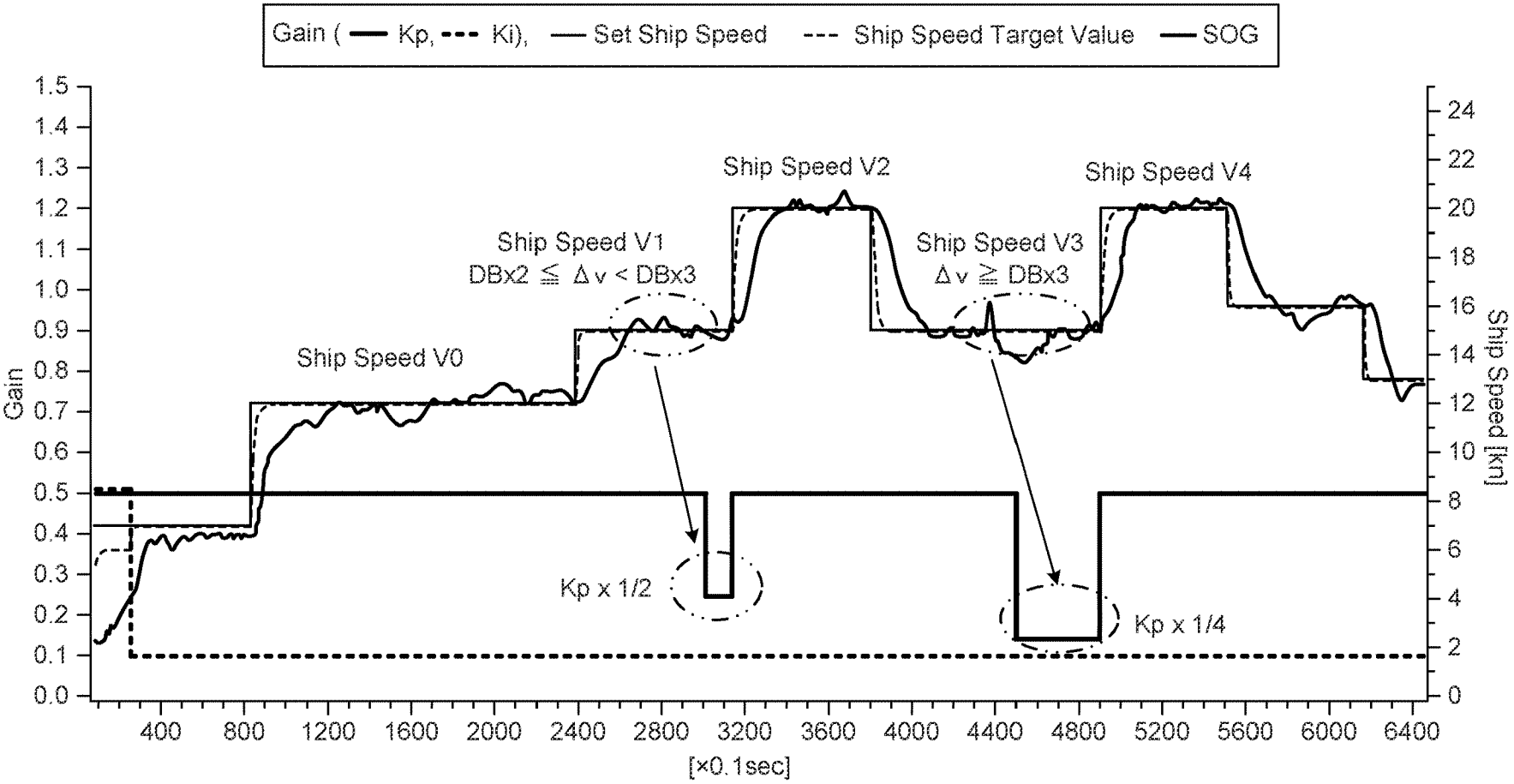
FIG. 6 is a graph showing changes in ship speed and proportional gain in the ship speed control system, according to the first embodiment.

In the first embodiment, a ship speed control system, a ship speed control method, and a ship speed control program, according to an embodiment of the present invention, will be described with reference to the drawings. FIG. 1 is a functional block diagram showing the configuration of the ship speed control system 10 according to the first embodiment. FIG. 2 is a functional block diagram showing a configuration for controlling ship speed of the ship speed control system 10, according to the first embodiment. FIG. 3 is a flowchart showing the processing of the ship speed control system 10, according to the first embodiment. FIG. 4 is a flowchart showing a speed stability determination process in the ship speed control system 10, according to the first embodiment. FIG. 5 is a flowchart showing an input gain adjustment process in the ship speed control system 10, according to the first embodiment. FIG. 6 is a graph showing changes in the ship speed and proportional gain $K_p$ in the ship speed control system 10, according to the first embodiment.

First, the effect of disturbance on the constant speed operation in an automatic ship speed control is shown. Ships may be affected by external disturbances (for example, following wave, opposite wave, tail wind, head wind) when performing the automatic ship speed control. Under this influence, the ship speed becomes unstable. In other words, the ride quality and comfortability of a person on board a ship may become unstable, and the safety of the person on board may not be secured.

The effect of the disturbance described above, may be eliminated by steering while the passenger makes fine manual adjustment. However, since such fine adjustment is largely due to the experience and knowledge of the passenger, it is difficult to make the fine adjustment at the time of the automatic ship speed control. For example, when the ship speed is brought close to the ship speed target value in the automatic ship speed control as shown in Japanese Patent Application Laid-Open No. 2002-316455, then the passenger's ride quality and comfortability may not be obtained only by quickly bringing the ship speed closer or setting the engine speed corresponding to the ship speed target value.

The ship speed control system 10 of the present invention is used in order to secure the ride quality, comfort, and safety of a passenger while solving the above-mentioned problems. The ship speed control system 10 uses the proportional gain $K_p$ as an input gain and performs control according to the actual ship speed V. A detailed configuration of the ship speed control system 10 is shown below.

As shown in FIG. 1, the ship speed control system 10 includes an Autopilot (AP) device 101 and an operation module 60. The AP device 101 and the operation module 60 are mounted on a ship for performing autopilot control (i.e. automatic navigation control). Further, the ship speed control system 10 is connected to a propulsion generation module 91 and a rudder 92. The propulsion generation module 91 and the rudder 92 are provided in, for example, an outboard motor, an inboard motor, an outboard motor, and various propellers.

The AP device 101 includes an autopilot (AP) control module 20, an autopilot (AP) operation module 30, a sensor module 40, and a display module 50.

The AP control module 20, the AP operation module 30, the sensor module 40, and the display module 50 are connected to each other by a data communication network 150 for ships. The AP control module 20, the operation module 60, and the propulsion generation module 91 are connected via, for example, a propulsion communication network (CAN, etc.). The AP control module 20 and the rudder 92 are connected via an analog voltage or data communication.

The AP control module 20 includes, for example, an arithmetic processing module such as a Central Processing Unit (CPU) and a storage module. The storage module stores a program to be executed by the AP control module 20. The storage module is used when the CPU performs operations. The AP control module 20 includes a main control module 200 and a ship speed control module (processing circuitry) 210.

The main control module 200 generally performs main control of the autopilot control (i.e. automatic navigation control) of the ship speed and a steering angle executed by the AP control module 20. For example, the main control module 200 receives the setting of the autopilot control by the AP operation module 30. The main control module 200 analyzes the set contents and controls the processing timing or the like of the ship speed control module 210 so as to realize the set autopilot control. The main control module 200 monitors the operation state received from the operation module 60. The main control module 200 may also control the autopilot in consideration of the monitoring result.

The main control module 200 gives a set ship speed $V_p$ from the AP operation module 30 to the ship speed control module 210. Here, the set ship speed $V_p$ is the ship speed (i.e. speed) to be finally followed in the autopilot control. The ship speed control module 210 may directly acquire the set ship speed $V_p$.

The ship speed control module (processing circuitry) 210 calculates a ship speed target value $V_t$ from the set ship speed $V_p$. The ship speed target value $V_t$ is a ship speed set to bring the actual ship speed V closer to the set ship speed $V_p$ during the automatic ship speed control. The ship speed control module 210 performs a proportional integral (PI) control using the difference between the ship speed target value $V_t$ and the actual ship speed V as an input to calculate a control ship speed for bringing the actual ship speed V closer to the ship speed target value $V_t$, and thereafter calculates a throttle operation value from the control ship speed.

The ship speed control module 210 sets a throttle command value using the following conditions, the actual ship speed V, the set ship speed $V_p$, the ship speed target value $V_t$, and the throttle operation value. The ship speed control module 210 outputs the throttle command value to the propulsion generation module 91. The propulsion generation module 91 controls propulsive force according to the throttle command value. The ship speed control module 210 corresponds to the ship speed controller of the present invention.

The AP operation module 30 is realized by, for example, a touch panel, a physical button or a switch. The AP operation module 30 accepts an operation of setting related to the autopilot control. The AP operation module 30 outputs the setting contents to the AP control module 20.

The sensor module 40 measures the speed (actual ship speed V) of the ship provided with the ship speed control system 10 and ship azimuth (bow azimuth and stern azimuth). For example, the sensor module 40 is realized by a positioning sensor using a positioning signal of a Global navigation satellite system GNSS (For example, GPS), an inertial sensor (an acceleration sensor, an angular velocity sensor, etc.), a magnetic sensor, or the like.

The display module 50 is realized by, for example, a liquid crystal panel. The display module 50 displays information related to the navigation of the normal autopilot inputted from the AP control module 20. Although the display module 50 may be omitted, it is preferable to have the display module 50, and the user may easily grasp the control state and the navigation state of the autopilot.

The operation module 60 includes an operation lever and an operation state detection module. The operation lever accepts an operation from a user during manual navigation. The operation state detection module is realized by a sensor or the like. The operation state detection module detects an operation state of the operation lever. The operation state detection module outputs the detected operation state (angle) of the operation lever to the propulsion generation module 91. During manual navigation, the propulsion generation module 91 generates a propulsive force of a size corresponding to the operation state. As described above, the operation state is monitored by the AP control module 20. For example, at the time of switching from the manual operation to the autopilot control, the AP control module 20 executes the initial control of the autopilot control with reference to this operation state.

With reference to FIGS. 2 and 3, an outline of the processing of the ship speed control module (processing circuitry) 210 in the ship speed control system 10 will be described. The ship speed control module 210 of the ship speed control system 10 includes a ship speed target value calculation module 211, a ship speed deviation calculation module 212, a speed stability determination module 213, an input gain adjustment module 214, a proportional integral (PI) control module 215, and a rotation speed (RPM) calculation module 216. In other words, all the functions by each of the above-mentioned modules; a ship speed target value calculation module 211, a ship speed deviation calculation module 212, a speed stability determination module 213, an input gain adjustment module 214, a proportional integral (PI) control module 215, and a rotation speed (RPM) calculation module 216, shall be performed by the processing circuitry (the ship speed control module) 210.

The ship speed target value calculation module 211 receives an input of a set ship speed $V_p$. The ship speed target value calculation module 211 calculates a ship speed target value $V_t$ (Target Vessel Speed $V_t$) from the set ship speed $V_p$ (S101). The ship speed target value calculation module 211 outputs the ship speed target value $V_t$, to the ship speed deviation calculation module 212. The ship speed target value calculation module 211 may be omitted. In this case, the set ship speed $V_p$ is inputted to the ship speed deviation calculation module 212 as the ship speed target value $V_t$, as it is.

The ship speed deviation calculation module 212 acquires the ship speed target value $V_t$ from the ship speed target value calculation module 211 and an actual ship speed V from a sensor module 40 of a ship 500. The ship speed deviation calculation module 212 calculates a difference (Hereinafter, the ship speed deviation Δv) between the actual ship speed V and the ship speed target value $V_t$ (S102). The ship speed deviation calculation module 212 outputs the ship speed deviation Δv to the speed stability determination module 213.

The speed stability determination module 213 compares the ship speed deviation Δv with a threshold DB to determine whether or not the ship speed of the ship 500 has reached a predetermined speed (hereinafter referred to as constant speed) (S103). The threshold DB corresponds to a "third threshold" of the present invention.

When the ship speed deviation Δv is equal to or less than the threshold DB, the speed stability determination module 213 determines that the ship speed of the ship 500 has reached the constant speed, in other words, that it is within the range of the ship speed (V0, V1, V2, V3, V4) which may be determined as the constant speed of the ship speed target value $V_t$. On the other hand, when the ship speed deviation Δv is larger than the threshold DB, the speed stability determination module 213 determines that the ship speed of the ship 500 has not reached the constant speed. The speed stability determination module 213 outputs these results to the input gain adjustment module 214.

The input gain adjustment module 214 determines an input gain (proportional gain $K_p$) from the comparison result of the ship speed deviation Δv and the threshold DB (S104). The input gain adjustment module 214 outputs the proportional gain $K_p$ to the PI control module 215. The proportional gain $K_p$ is a predetermined value larger than 0.

The PI control module 215 performs PI control using the input proportional gain $K_p$ (S105). Accordingly, the PI control module 215 inputs the proportional gain $K_p$ to the throttle control function to calculate the directive ship speed (S106). The PI control module 215 outputs the directive ship speed to the rotation speed calculation module 216.

The rotation speed calculation module 216 calculates a set RPM (set engine speed) from the directive ship speed (S107). The rotation speed calculation module 216 gives the set RPM to the propulsion generation module 91. The propulsion generation module 91 generates propulsive force according to the setting RPM. The ship 500 navigates by receiving this propulsion force, and its speed (actual ship speed V) is measured by the sensor module 40. The actual ship speed V measured by the sensor module 40, is fed back to the ship speed deviation calculation module 212.

At this time, by executing the following control, the ship speed control system 10 may navigate the ship 500 in consideration of the ride quality and comfortability of the passengers.

A more specific control method of the ship speed control system 10 will be described with reference to FIGS. 4 and 5. First, with reference to the flowchart of FIG. 4, a speed stability determination process in the ship speed control system 10, according to the first embodiment, will be described. FIG. 4 shows the details of the processing of the speed stability determination step S103 in the flowchart shown in FIG. 3.

The speed stability determination module 213 determines whether or not there is a change in the set ship speed $V_p$ (S111). If the set ship speed $V_p$ is changed by the user's input (S111: Yes), then the speed stability determination module 213 sets the speed stability determination flag to FALSE (S112). When the ship speed of the ship 500 reaches a constant speed with respect to the ship speed target value $V_t$, the speed stability determination flag becomes TRUE. On the other hand, if the ship speed of the ship 500 does not reach the constant speed with respect to the ship speed target value $V_t$, the speed stability determination flag becomes FALSE.

If there is no change in the set ship speed $V_p$ (S111: No), then the speed stability determination module 213 performs the processing of step S113 without changing the state of the speed stability determination flag.

The threshold DB is a predetermined value that may be determined by the passenger under conditions such as the specifications of the ship 500, the load weight, and the disturbance resistance (weather, wind speed, and wind direction).

Further, the speed stability determination module 213 checks the status of the speed stability determination flag. When the speed stability determination flag is FALSE (S113: FALSE), then the speed stability determination module 213 sets initial values to the proportional gain $K_p$ and an integral gain $K_i$ (S114).

As described above, the proportional gain $K_p$ may be a predetermined value larger than 0. In the present embodiment, the proportional gain $K_p$ is assumed to be 0.5 and the integral gain $K_i$ is assumed to be 0.1.

After setting the proportional gain $K_p$ and the integral gain $K_i$, the speed stability determination module 213 performs ship speed control, calculates a ship speed deviation Δv in a predetermined cycle, and performs speed stability determination. Specifically, the speed stability determination module 213 compares the ship speed deviation Δv with the threshold DB (S115). When the ship speed deviation Δv is equal to or smaller than the threshold DB (S115: Yes), the speed stability determination flag is set to TRUE (S116). Thereafter, the speed stability determination module 213 sets the input gain adjustment prohibition flag to OFF (S117).

An input gain adjustment inhibition flag is a flag configured to determine whether the proportional gain $K_p$ may be adjusted. Although the details will be described later, the input gain adjustment inhibition flag is set to ON when, for example, the proportional gain $K_p$ is adjusted (twice). In other words, the adjustment of the proportional gain $K_p$ is prohibited. In this case, an input gain adjustment flag specifies that the proportional gain $K_p$ may be adjusted up to two times.

If the ship speed deviation Δv is larger than the threshold DB (S115: No), then the process returns to step S111.

When the speed stability determination flag is TRUE (S113: TRUE), then the speed stability determination module 213 performs an input gain adjustment processing (S118). The input gain adjustment process in step S118 will be described in detail with reference to FIG. 5.

Next, with reference to the flowchart of FIG. 5, the input gain adjustment process in the ship speed control system 10, according to the first embodiment, will be described. FIG. 5 shows details of the processing in step S104 of the input gain adjustment process in the flowchart shown in FIG. 3 and step S118 in FIG. 4.

Firstly, an outline of the processing of the input gain adjustment module 214 will be described. In the present invention, the input gain adjustment module 214 adjusts a proportional gain $K_p$ inputted to the PI control module 215, and sets an integral gain $K_i$ to a constant value. However, the integral gain $K_i$ may be similarly adjusted. In other words, it is possible to adjust the integral gain $K_i$ together with the proportional gain $K_p$ if it is possible to improve the ride quality and safety performance of the passenger during the constant speed operation.

The input gain adjustment module 214 confirms an input gain adjustment prohibition flag (S121). When the input gain adjustment prohibition flag is OFF (S121: OFF), then the ship speed deviation Δv is compared with 3 times of the threshold DB. Three times the threshold DB corresponds to a "first threshold" of the present invention.

When the ship speed deviation Δv is 3 times or more of the threshold DB (Yes in S122), the input gain adjustment module 214 sets the proportional gain $K_p$ to ¼ of the initial value (S123). In the above case, it is set to ¼ of the proportional gain $K_p$ (0.5). That is, the proportional gain $K_p$ is 0.125. A value of ¼ of the proportional gain $K_p$ (0.125 in this case) corresponds to a "first gain value" of the present invention.

After setting the proportional gain $K_p$ (0.5) to ¼, the input gain adjustment module 214 sets the input gain adjustment prohibition flag to ON (S124). The input gain adjustment module 214 sets the input gain adjustment inhibition flag to ON even when the proportional gain $K_p$ is changed to a predetermined number of times (2 times in this embodiment).

When the ship speed deviation Δv is smaller than 3 times the threshold DB (S122: No), the input gain adjustment module 214 compares the ship speed deviation Δv with 2 times the threshold DB S125. The double of the threshold DB corresponds to a "second threshold" of the present invention.

When the ship speed deviation Δv is 2 times or more of the threshold DB and less than 3 times of the threshold DB (Yes in S125), the input gain adjustment module 214 sets the proportional gain $K_p$ to ½ of the initial value S126. In the above case, it is set to ½ of the proportional gain $K_p$ (0.5). That is, the proportional gain $K_p$ is 0.25. A value of ½ of the proportional gain $K_p$ (0.25 in this case) corresponds to a "second gain value" of the present invention.

When the input gain adjustment prohibition is ON (S121: ON), the input gain adjustment module 214 ends the loop of the processing shown in FIG. 5. Similarly, if the ship speed deviation Δv is smaller than 2 times the threshold DB (S125: No), then the input gain adjustment module 214 ends the loop of processing shown in FIG. 5.

By setting the proportional gain $K_p$ in this way, the ship 500 may approach the ship speed target value $V_t$ without performing rapid acceleration and rapid deceleration with respect to the ship speed target value $V_t$. That is, the ship 500 may navigate in consideration of the ride quality and the comfortability of the passengers.

FIG. 6 is a graph showing changes in the ship speed and proportional gain $K_p$ and changes in the ship speed in the ship speed control system 10, according to the first embodiment. The example shown in FIG. 6 will be described with reference to an example of adjusting the proportional gain $K_p$ when the SOG (ship speed) is changed from the ship speed V0 to the ship speed V4. The SOG is the "Speed Over Ground".

Changing from Vessel Speed V0 to Vessel Speed V1—The ship (vessel) 500 is proceeding at a vessel speed V0 (12 kn). The passenger sets the set ship speed $V_p$ to the ship speed V1 (15 kn). Thus, the ship speed target value calculation module 211 calculates the ship speed target value $V_t$ from the set ship speed $V_p$. The ship speed target value calculation module 211 calculates a ship speed deviation Δv from an actual ship speed V of a ship 500 and a ship speed target value $V_t$.

A speed stability determination module 213 compares the ship speed deviation Δv with a threshold DB. When it is confirmed that the ship speed deviation Δv becomes equal to or less than the threshold DB (it is confirmed that the ship speed deviation Δv is stabled), the speed stability determination flag is set to TRUE, and the input gain adjustment prohibition flag S121 is set to OFF.

Thereafter, when the ship speed deviation Δv becomes 2 times or more and 3 times or less of the threshold DB, the input gain adjustment module 214 sets the proportional gain $K_p$ to ½ of the initial value, that is, the proportional gain $K_p$=0.25 (Around 300 sec in FIG. 6).

Changing from Vessel Speed V1 to Vessel Speed V2

The ship 500 is proceeding at a ship speed V1 (15 kn). The passenger sets the set ship speed $V_p$ to the ship speed V2 (20 kn). An input gain adjustment module 214 resets the proportional gain $K_p$ to an initial value, that is, the proportional gain $K_p$=0.5. The ship speed target value calculation module 211 calculates a ship speed target value $V_t$ from a set ship speed $V_p$. The ship speed target value calculation module 211 calculates a ship speed deviation Δv from an actual ship speed V of a ship 500 and a ship speed target value $V_t$.

A speed stability determination module 213 compares the ship speed deviation Δv with a threshold DB. When it is confirmed that the ship speed deviation Δv becomes equal to or less than the threshold DB (it is confirmed that the ship speed deviation Δv is stabled), the speed stability determination flag is set to TRUE, and the input gain adjustment prohibition flag is set to OFF.

When the ship speed deviation Δv is smaller than 2 times of the threshold DB, the input gain adjustment module 214 does not change the proportional gain $K_p$ from the initial value.

Changing from Vessel Speed V2 to Vessel Speed V3—The ship 500 is proceeding at a ship speed V2 (20 kn). The passenger sets the set ship speed $V_p$ to the ship speed V3 (15 kn). The input gain adjustment module 214 resets the proportional gain $K_p$ to an initial value, that is, the proportional gain $K_p$=0.5. The ship speed target value calculation module 211 calculates a ship speed target value $V_t$ from a set ship speed $V_p$. The ship speed target value calculation module 211 calculates a ship speed deviation Δv from an actual ship speed V of a ship 500 and a ship speed target value $V_t$.

A speed stability determination module 213 compares the ship speed deviation Δv with a threshold DB. When it is confirmed that the ship speed deviation Δv becomes equal to or less than the threshold DB (it is confirmed that the ship speed deviation Δv is stabled), then the speed stability determination flag is set to TRUE, and the input gain adjustment prohibition flag is set to OFF.

Thereafter, when the ship speed deviation Δv becomes 3 times or more of the threshold DB, the input gain adjustment module 214 sets the proportional gain $K_p$ to ¼ of the initial value, that is, the proportional gain $K_p$=0.125 (Around 440 sec in FIG. 6).

Changing from Vessel Speed V3 to Vessel Speed V4—The ship (vessel) 500 is proceeding at a vessel speed V3 (15 kn). The passenger sets the set ship speed $V_p$ to the ship speed V4 (20 kn). The input gain adjustment module 214 resets the proportional gain $K_p$ to an initial value, that is, the proportional gain $K_p$=0.5. The ship speed target value calculation module 211 calculates a ship speed target value $V_t$ from a set ship speed $V_p$. The ship speed target value calculation module 211 calculates a ship speed deviation Δv from an actual ship speed V of the ship 500 and a ship speed target value $V_t$.

A speed stability determination module 213 compares the ship speed deviation Δv with a threshold DB. After determining that the ship speed V4 becomes the constant speed, the input gain adjustment module 214 determines that the ship speed deviation Δv is equal to or less than the threshold DB, and does not change the proportional gain $K_p$ from the initial value.

As described above, by setting the proportional gain $K_p$, the ship (vessel) 500 may approach the target vessel speed $V_t$ without performing rapid acceleration and rapid deceleration with respect to the target vessel speed $V_t$. That is, the ship 500 may navigate in consideration of the ride quality and the comfortability of the passengers.

In the above example, the proportional gain $K_p$ is changed up to twice. However, when the speed of the ship may be changed in consideration of the ride quality and the comfortability of the passenger in accordance with the change of the proportional gain $K_p$, the number of times of change of the proportional gain $K_p$ is not limited to two.

The above functions may be suitably combined. Then, the ship speed control system 10 may provide an effect corresponding to each combination.

DESCRIPTION OF REFERENCE CHARACTERS

DB . . . Threshold
$K_i$ . . . Integral Gain
$K_p$ . . . Proportional Gain
V . . . Actual Ship Speed
V0, V1, V2, V3, V4 . . . Ship Speed
$V_p$ . . . Set Ship Speed
$V_t$ . . . Ship Speed Target Value
10 . . . Ship Speed Control System
20 . . . Autopilot (AP) Control Module
30 . . . Autopilot (AP) Operation Module
40 . . . Sensor Module
50 . . . Display Module
60 . . . Operation Module
91 . . . Propulsion Generation Module
92 . . . Rudder
101 . . . Autopilot (AP) Device
150 . . . Data Communication Network
200 . . . Main Control Module
210 . . . Ship Speed Control Module (Processing Circuitry)
211 . . . Ship Speed Target Value Calculation Module
212 . . . Ship Speed Deviation Calculation Module
213 . . . Speed Stability Determination Module
214 . . . Input Gain Adjustment Module
215 . . . Proportional Integral (PI) Control Module
216 . . . Rotation Speed Calculation Module
500 . . . Ship

Terminology

It is to be understood that not necessarily all objects or advantages may be achieved in accordance with any particular embodiment described herein. Thus, for example, those skilled in the art will recognize that certain embodiments may be configured to operate in a manner that achieves or optimizes one advantage or group of advantages as taught herein without necessarily achieving other objects or advantages as may be taught or suggested herein.

All of the processes described herein may be embodied in, and fully automated via, software code modules executed by a computing system that includes one or more computers or processors. The code modules may be stored in any type of non-transitory computer-readable medium or other computer storage device. Some or all the methods may be embodied in specialized computer hardware.

Many other variations than those described herein will be apparent from this disclosure. For example, depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. In addition, different tasks or processes can be performed by different machines and/or computing systems that can function together.

The various illustrative logical blocks and modules described in connection with the embodiments disclosed herein can be implemented or performed by a machine, such as a processor. A processor can be a microprocessor, but in the alternative, the processor can be a controller, microcontroller, or state machine, combinations of the same, or the like. A processor can include electrical circuitry configured to process computer-executable instructions. In another embodiment, a processor includes an application specific integrated circuit (ASIC), a field programmable gate array (FPGA) or other programmable device that performs logic operations without processing computer-executable instructions. A processor can also be implemented as a combination of computing devices, e.g., a combination of a digital signal processor (DSP) and a microprocessor, a plurality of microprocessors, one or more microprocessors in conjunction with a DSP core, or any other such configuration. Although described herein primarily with respect to digital technology, a processor may also include primarily analog components. For example, some or all of the signal processing algorithms described herein may be implemented in analog circuitry or mixed analog and digital circuitry. A computing environment can include any type of computer system, including, but not limited to, a computer system based on a microprocessor, a mainframe computer, a digital signal processor, a portable computing device, a device controller, or a computational engine within an appliance, to name a few.

Conditional language such as, among others, "can." "could," "might" or "may," unless specifically stated otherwise, are otherwise understood within the context as used in general to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Any process descriptions, elements or blocks in the flow diagrams described herein and/or depicted in the attached figures should be understood as potentially representing modules, segments, or portions of code which include one or more executable instructions for implementing specific logical functions or elements in the process. Alternate implementations are included within the scope of the embodiments described herein in which elements or functions may be deleted, executed out of order from that shown, or discussed, including substantially concurrently or in reverse order, depending on the functionality involved as would be understood by those skilled in the art.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B and C" can include a first processor configured to carry out recitation A working in conjunction with a second processor configured to carry out recitations B and C. The same holds true for the use of definite articles used to introduce embodiment recitations. In addition, even if a specific number of an introduced embodiment recitation is explicitly recited, those skilled in the art will recognize that such recitation should typically be interpreted to mean at least the recited number (e.g., the bare recitation of "two recitations," without other modifiers, typically means at least two recitations, or two or more recitations).

It will be understood by those within the art that, in general, terms used herein, are generally intended as "open" terms (e.g., the term "including" should be interpreted as "including but not limited to," the term "having" should be interpreted as "having at least," the term "includes" should be interpreted as "includes but is not limited to," etc.).

For expository purposes, the term "horizontal" as used herein is defined as a plane parallel to the plane or surface of the floor of the area in which the system being described is used or the method being described is performed, regardless of its orientation. The term "floor" can be interchanged with the term "ground" or "water surface." The term "vertical" refers to a direction perpendicular to the horizontal as just defined. Terms such as "above," "below," "bottom," "top," "side," "higher," "lower," "upper," "over," and "under," are defined with respect to the horizontal plane.

As used herein, the terms "attached," "connected," "mated," and other such relational terms should be construed, unless otherwise noted, to include removable, moveable, fixed, adjustable, and/or releasable connections or attachments. The connections/attachments can include direct connections and/or connections having intermediate structure between the two components discussed.

Numbers preceded by a term such as "approximately," "about," and "substantially" as used herein include the recited numbers, and also represent an amount close to the stated amount that still performs a desired function or achieves a desired result. For example, the terms "approximately," "about," and "substantially" may refer to an amount that is within less than 10% of the stated amount. Features of embodiments disclosed herein preceded by a term such as "approximately," "about," and "substantially" as used herein represent the feature with some variability that still performs a desired function or achieves a desired result for that feature.

It should be emphasized that many variations and modifications may be made to the above-described embodiments, the elements of which are to be understood as being among other acceptable examples. All such modifications and variations are intended to be included herein within the scope of this disclosure and protected by the following claims.

What is claimed is:

1. A ship speed control system comprising:

processing circuitry configured:

to calculate a ship speed deviation based on a difference between an actual ship speed and a ship speed target value;

to adjust an input gain into a throttle control function to a first gain value when the ship speed deviation is equal to or larger than a first threshold value; and to adjust the input gain into the throttle control function to a second gain value larger than the first gain value and smaller than an initial value of the input gain when the ship speed deviation is smaller than the first threshold value and equal to or larger than a second threshold value.

2. The ship speed control system according to claim 1, wherein the processing circuitry is further configured:

to determine that the actual ship speed becomes stable with respect to the ship speed target value; and to allow adjustment of the input gain, when the ship speed deviation is equal to or less than a third threshold value; and to adjust the input gain to the first gain value when the adjustment of the input gain is allowed.

3. The ship speed control system according to claim 1, wherein:

the first gain value and the second gain value are values obtained by dividing a preset initial value of the input gain.

4. The ship speed control system according to claim 1, wherein:

the throttle control function is a control function under a proportional integral (PI) control.

5. The ship speed control system according to claim 4, wherein:

the processing circuitry is further configured to adjust the first gain value or the second gain value only for the proportional gain under the PI control.

6. The ship speed control system according to claim 1, wherein:

the processing circuitry is further configured to prohibit a subsequent adjustment of the input gain when the processing circuitry adjusts the input gain for a predetermined number of times.

7. The ship speed control system according to claim 1, wherein:

the processing circuitry is further configured to prohibit a subsequent adjustment of the input gain when the input gain reaches the first gain value.

8. The ship speed control system according to claim 1, wherein:

the processing circuitry is further configured to set the input gain to the initial value when a set ship speed is newly set by an input of a user.

9. The ship speed control system according to claim 8, wherein:

the processing circuitry is further configured to calculate the ship speed target value based on the set ship speed so that the actual ship speed approaches the set ship speed.

10. The ship speed control system according to claim 9, wherein:

the actual ship speed is a speed over ground.

11. The ship speed control system according to claim 1, wherein the processing circuitry is further configured:

to calculate the ship speed target value from a set ship speed;

to calculate the ship speed deviation based on the difference between the actual ship speed and the ship speed target value;

to adjust the input gain into a throttle control function when the ship speed deviation is larger than the threshold value;

to determine from the ship speed deviation that the ship speed has become stabled;

to make the input gain adjustment effective;

to calculate a directive ship speed to be given to the throttle by using the input gain; and to calculate rotational speed from the directive ship speed.

12. A ship speed control method comprising:

calculating a ship speed deviation based on a difference between an actual ship speed and a ship speed target value;

determining whether the ship speed deviation is equal to or larger than a first threshold value or is smaller than the first threshold value and equal to or larger than a second threshold value;

adjusting an input gain into a throttle control function to a first gain value when the ship speed deviation is equal to or larger than the first threshold value; and adjusting the input gain into the throttle control function to a second gain value larger than the first gain value and smaller than an initial value of the input gain when the ship speed deviation is smaller than the first threshold value and equal to or larger than the second threshold value.

13. A non-transitory computer-readable storage medium storing processor-executable instructions that, when executed, cause one or more processors:

to calculate a ship speed deviation based on a difference between an actual ship speed and a ship speed target value;

to adjust an input gain into a throttle control function to a first gain value when the ship speed deviation is equal to or larger than a first threshold value; and to adjust the input gain into the throttle control function to a second gain value larger than the first gain value and smaller than an initial value of the input gain when the ship speed deviation is smaller than the first threshold value and equal to or larger than a second threshold value.

14. The ship speed control system according to claim 9, wherein the processing circuitry is further configured:

to determine that the actual ship speed becomes stable with respect to the ship speed target value; and to allow adjustment of the input gain, when the ship speed deviation is equal to or less than a third threshold value; and to adjust the input gain to the first gain value when the adjustment of the input gain is allowed.

15. The ship speed control system according to claim 2, wherein:

the first gain value and the second gain value are values obtained by dividing a preset initial value of the input gain.

16. The ship speed control system according to claim 2, wherein:

the throttle control function is a control function under a proportional integral (PI) control.

17. The ship speed control system according to claim 16, wherein:

the processing circuitry is further configured to adjust the first gain value or the second gain value only for the proportional gain under the PI control.

18. The ship speed control system according to claim 2, wherein:

the processing circuitry is further configured to prohibit a subsequent adjustment of the input gain when the processing circuitry adjusts the input gain for a predetermined number of times.

19. The ship speed control system according to claim 2, wherein:

the processing circuitry is further configured to prohibit a subsequent adjustment of the input gain when the input gain reaches the first gain value.

20. The ship speed control system according to claim 2, wherein:

the processing circuitry is further configured to set the input gain to the initial value when a set ship speed is newly set by an input of a user.

* * * * *